United States Patent [19]

Simpson

[11] Patent Number: 4,886,056

[45] Date of Patent: Dec. 12, 1989

[54] BREATHING APPARATUS

[75] Inventor: Keith Simpson, Odiham, United Kingdom

[73] Assignee: Sabre Safety Limited, Hampshire, England

[21] Appl. No.: 326,080

[22] Filed: Mar. 20, 1989

[30] Foreign Application Priority Data

Mar. 21, 1988 [GB] United Kingdom ..... 8806713

[51] Int. Cl.[4] ..... A62B 7/10

[52] U.S. Cl. ..... 128/201.25; 128/206.15; 128/204.29; 128/204.21

[58] Field of Search ..... 128/204.28, 204.29, 128/206.15, 201.25, 201.28, 201.23, 204.21, 205.27, 206.12, 207.12

[56] References Cited

U.S. PATENT DOCUMENTS

| | | | |
|---|---|---|---|
| 2,029,566 | 2/1936 | Herzer | 128/201.25 |
| 4,331,141 | 5/1982 | Poultos | 128/201.25 |
| 4,364,384 | 12/1982 | Warnicke et al. | 128/205.12 |
| 4,430,995 | 2/1984 | Hilton | 128/204.21 |
| 4,502,480 | 3/1985 | Yamamoto | 128/201.25 |
| 4,549,542 | 10/1985 | Chien | 128/205.12 |
| 4,584,996 | 4/1986 | Blum | 128/204.21 |
| 4,646,732 | 3/1987 | Chien | 128/206.15 |
| 4,676,236 | 6/1987 | Plorkowski et al. | 128/201.25 |
| 4,827,964 | 5/1989 | Guido | 128/204.21 |

FOREIGN PATENT DOCUMENTS 0094757 11/1983 European Pat. Off. .

*Primary Examiner*—Eugene H. Eickholt
*Attorney, Agent, or Firm*—Bacon & Thomas

[57] ABSTRACT

A positive pressure filter respirator includes a full face mask comprising an outer mask 1 and an inner orinasal mask 2. A filter canister 5 is screw mounted to an air inlet 4, and a centrifugal fan 6, which is driven by a battery operated motor 7, is so arranged as to draw air through the filter canister 5 into the outer mask 1. The filter life and the battery life are extended by the use of a pressure responsive means which responds to the difference in pressure between the pressure in the interior of the orinasal mask 2 and the pressure in the space 20 within the outer mask 1 and outside the orinasal mask 2. The pressure responsive means reacts immediately to the commencement of either exhalation or inhalation to disable the fan 6 or on commencement of exhalation and to accelerate the fan 6 on commencement of inhalation. The pressure responsive means comprises a diaphragm 9 and an infra-red proximity detector 10 mounted close to the diaphragm 9, and as described, the pressure responsive means acts to switch off the fan 6 at the commencement of exhalation and to switch the fan 6 on at commencement of inhalation.

10 Claims, 2 Drawing Sheets

BREATHING APPARATUS

BACKGROUND OF THE INVENTION (1) Field of the invention

This invention relates to breathing apparatus, and more particularly to positive pressure breathing apparatus.

In positive pressure breathing apparatus a positive pressure greater than the ambient pressure is maintained within a protective device such as a face mask or a hood surrounding the respiratory passages of a wearer. The use of positive pressure has the particular advantage that, if there is any leakage, the leakage will all be outward from the protective device thus providing a high degree of protection against the ingress of noxious fumes into the gas which the wearer of the apparatus is breathing.

Positive pressure filter respirators are one form of positive pressure breathing apparatus in which the positive pressure is provided by means of an air mover such as a blower or a fan which delivers air through a filter to the interior of a face mask, helmet or hood. The air mover, which may be a battery-driven electrical device, removes from the wearer the need to overcome the resistance of the filter and so reduces the breathing effort required.

In such conventional positive pressure respirators the positive pressure is maintained by means of a high flow of air, at least 120 liters per minute but preferably of the order of 160 liters per minute. Most of this air is wasted since the 20–40 liters per minute of air which is required for breathing is required during the inhale part of the cycle only, but the air mover continues to supply air during the remainder of the breathing cycle. Whilst in some cases the high flow of air is beneficial in terms of cooling the wearer, it is wasteful in terms of filter life and battery life.

Positive pressure filter respirators for use in highly toxic environments comprise an inner or orinasal mask within an outer protective member, which may be a hood, a helmet or a mask, a barrier layer of filtered gas being maintained in the outer protective member around the inner or orinasal mask.

(2) Description of the prior art

In U.K. Patent Specification No. 2,032,284 A it is proposed to improve the filter life in breathing apparatus of this kind generally by detecting exhalation by the wearer and at least reducing flow of air through the filter during at least part of each exhale part of the breathing cycle of the wearer. It is disclosed that, in breathing apparatus having no inner or orinasal mask, the air mover or pump may be stopped, but it is preferred that the speed of the air mover is reduced. In breathing apparatus having an inner or orinasal mask and an outer mask, the speed of the air mover is regulated in consequence of the build up in pressure in the outer mask following closure of inhale valves in the inner mask during exhalation. This build up is detected by a detector in the outer mask operating in response to the pressure difference between the outer mask and the ambient atmosphere. Because the exhale valve in the inner mask opens directly to atmosphere, the build up in pressure in the outer mask occurs as a result of the continued running of the fan after exhalation commences, and there is consequently a slow response of the detector to the commencement of exhalation and the improvement in the filter life and battery life is significantly less than it might be.

In U.K. Patent Specification No. 2,141,348 A there is disclosed breathing apparatus which is a positive pressure filter respirator having inner and outer masks. The life of the filter in this apparatus is extended by disconnecting the pump means or fan from the power means in response to detection of the pressure of air between the pump means and the filter means by a pressure sensor. Again there is a slow response to the commencement of exhalation because the pressure which is sensed is dependent on the continued running of the pump means after the inhale valves in the inner mask close. There is therefore delay before the pump means or fan is disabled. Also, considerable effort by the wearer is required at the commencement of inhalation in order to reduce the pressure within both the inner and outer masks below atmospheric before the pressure sensor located between the pump means and the filter will reconnect the power means to the pump means or fan. There is therefore considerable risk of noxious gases leaking into the outer mask during this early portion of the inhale part of the breathing cycle.

SUMMARY OF THE INVENTION

According to the present invention there is provided breathing apparatus for excluding noxious atmospheric gases from the respiratory passages of a wearer, the breathing apparatus comprising:

(a) an outer member, (b) an orinasal mask located within the outer member, (c) an inhale valve mounted in the orinasal mask and operable to connect the interior of the orinasal mask with the space within the outer member and outside the orinasal mask, (d) an exhale valve mounted in the orinasal mask and operable to connect the interior of the orinasal mask direct to the ambient atmosphere, (e) an air inlet to the outer member, (f) a filter mounted in the air inlet, (g) air moving means for moving air through the filter into the outer member to establish a pressure above ambient pressure within the outer member and outside the orinasal mask, (h) a power source for driving the air moving means, and (i) pressure responsive means responsive to the pressure difference between the pressure in the interior of the orinasal mask and the pressure in the space within the outer member and outside the orinasal mask for disabling the air moving means at the commencement of an exhale period in a breathing cycle and accelerating the air moving means at the commencement of an inhale period in the breathing cycle.

The outer member may be a flexible hood, a helmet or a full face mask.

More specifically in accordance with the embodiment of the present invention which will be described there is provided a positive pressure filter respirator comprising a full face mask including:

(a) an outer mask for engaging the head of a wearer to exclude noxious atmospheric gases from a region within the outer mask, (b) an orinasal mask within the outer mask and engaging the face of the wearer to surround his respiratory passages, (c) an inhale valve mounted in the orinasal mask and operable to connect the interior of the orinasal mask with the space within the outer mask and outside the orinasal mask, (d) an exhale valve mounted in the orinasal mask and operable to connect the interior of the orinasal mask direct to the ambient atmosphere, (e) an air inlet to the outer mask, (f) a filter mounted to the outer mask to filter air passing through the air inlet, (g) a fan located in the space within the outer mask and outside the orinasal mask for moving air through the filter into the outer mask to establish a pressure above ambient pressure within the outer mask and outside the orinasal mask, (h) a fan motor for driving the fan to move air through the filter, (i) detector means located within the orinasal mask for detecting an increase in gas pressure within the orinasal mask relative to the gas pressure in the outer mask consequent upon exhalation by the wearer, and (j) control means responsive to detection of the said increase in gas pressure within the orinasal mask by the detector means for disabling the fan motor.

Preferably the pressure responsive means or detector means which is used in breathing apparatus according to the present invention comprises a diaphragm mounted in the proximity of an infra-red detector which gives an output dependent on the position adopted by the diaphragm under the gas pressure within the orinasal mask relative to the gas pressure in the outer member or mask.

The pressure responsive means or detector means may give a signal upon detection of a predetermined increase in the gas pressure within the orinasal mask relative to the gas pressure in the outer member, and the control means be responsive to the said signal to disable the air moving means, either by disconnecting the power source from the air moving means or by slowing the air moving means to idling speed.

Conveniently the control means includes a relay operable, when the gas pressure in the orinasal mask relative to the gas pressure in the outer member or mask increases above a predetermined level, to disable the air moving means by disconnecting a power source driving the air moving means.

The pressure responsive means, or detector means, is thus arranged to stop positive operation of the air moving means when the pressure in the orinasal mask rises relative to the gas pressure in the outer member or mask on exhalation and to reconnect a power drive to the air moving means when the gas pressure in the orinasal mask drops below the gas pressure in the outer member or mask upon inhalation. The relatively small volume of the orinasal mask and its proximity to the wearer's breathing passages ensure a swift response to the commencement of both exhalation and inhalation.

Conveniently the air moving means is a fan. Although a centrifugal fan will be described and illustrated, other forms of fan, for example an axial fan, may be used.

Breathing apparatus in accordance with the present invention has a more positive response to the change in pressure at the beginning of each of the inhale and exhale periods of the breathing cycle than apparatus proposed or used hitherto.

Breathing apparatus according to the present invention has a longer period of disabling of the drive means to the air mover and thus gives a longer filter life than known apparatus. Also the breathing apparatus of the present invention uses less power in each breathing cycle than known breathing apparatus of this kind.

Breathing apparatus according to the present invention enables the operation of the motor driving the fan to be discontinued and recommenced without creating a pressure lower than atmospheric within both the inner and outer masks and thereby risking the entry of toxic gas into the outer mask from which breathing gas is taken into the inner mask.

In breathing apparatus according to the present invention the fan is switched on at the commencement of the inhalation period of the breathing cycle without placing a significant physiological burden on the wearer.

Breathing apparatus in accordance with the present invention provides a high degree of protection, as a result of positive pressure, for a longer period than the known conventional positive pressure respirators without having recourse to larger or more expensive components, and such breathing apparatus is very advantageous in circumstances where a continuous high flow of air is not required.

BRIEF DESCRIPTION OF THE DRAWINGS

The present invention will be further understood from the following detailed description of a preferred embodiment thereof which is made, by way of example, with reference to the accompanying drawings, in which.

DETAILED DESCRIPTION

Figure 1:
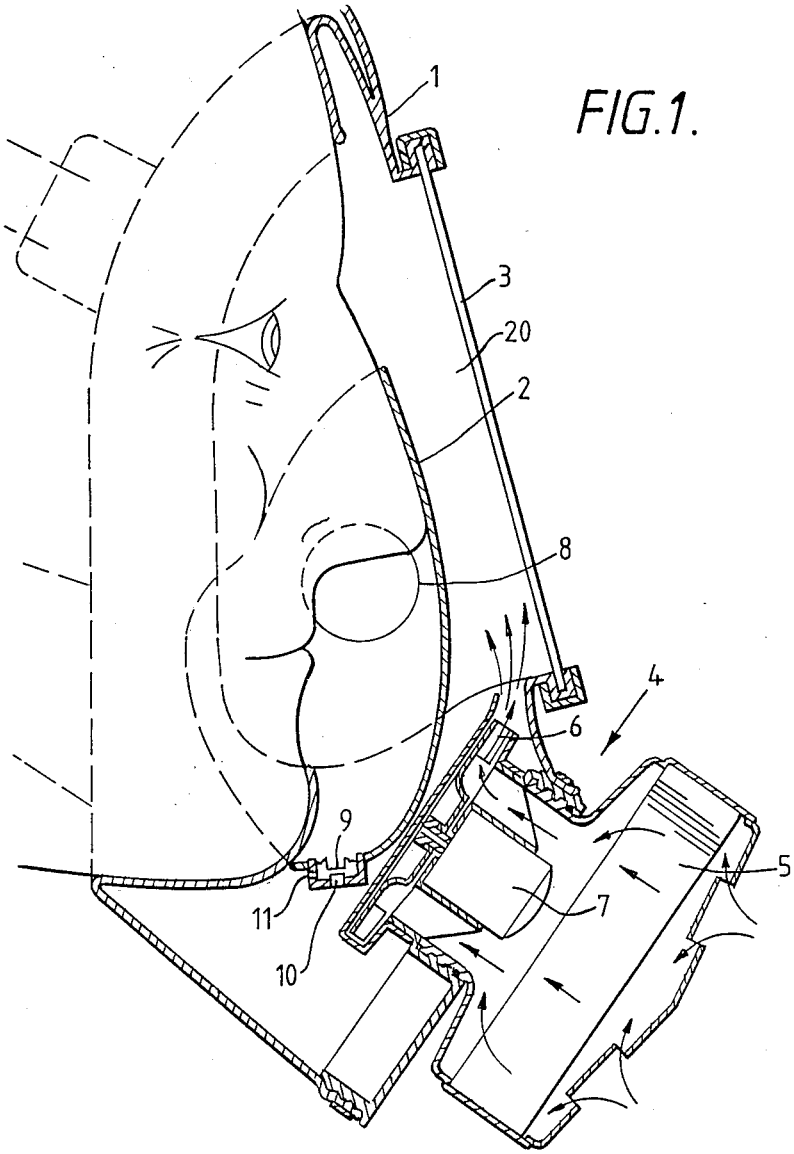
FIG. 1 is a cross-sectional side view of a positive pressure filter respirator incorporating the present invention.

Referring to FIG. 1 there is shown a positive pressure filter respirator which includes a full face mask comprising an outer mask 1 and an inner orinasal mask 2 surrounding the respiratory passages of a wearer.

The outer mask 1 includes a visor 3 and an air inlet generally designated 4 to which a filter canister 5 is screw-mounted. Immediately within the filter canister 5 there is located a centrifugal fan 6 which is arranged to be driven by a battery-operated motor 7 so as to draw air through the filter canister 5 and into the interior of the outer mask 1.

In operation the fan 6 draws air through the filter canister 5 at a rate greater than the rate of leakage of gas from the full face mask so that a positive pressure above the pressure of the ambient atmosphere is maintained within the outer mask 1.

Mounted on opposite sides of the orinasal mask 2 are an inhale valve 8 and an exhale valve which is not shown in FIG. 1 but which is in a similar position to the inhale valve 8 on the opposite side of the orinasal mask 2 to the inhale valve 8. However, the inhale valve 8 connects the interior of the inner orinasal mask 2 to the space 20 within the outer mask 1, whereas the exhale valve connects the interior of the orinasal mask 2 direct to the ambient atmosphere outside the outer mask 1.

There is also provided within the orinasal mask 2 a pressure sensing diaphragm 9 which is mounted close to a solid state infra-red proximity detector 10 so that the pressure sensing diaphragm 9 moves relative to the proximity detector 10 in accordance with the difference between the gas pressure within the inner orinasal mask 2 and the gas pressure in the space 20 within the outer mask 1, an aperture 11 in the body of the orinasal mask 2 on the underside of the diaphragm 9 communicating with the space 20 within the outer mask 1 but outside the orinasal mask 2.

The output from the proximity detector 10 is used by a circuit which will be described with reference to FIG. 2 in order to disable the fan motor 7 when the gas pressure within the orinasal mask 2 rises relative to the gas pressure in the space 20 as the wearer exhales.

In consequence the fan motor 7 is switched off during the exhale period of the breathing cycle and remains off during the rest period of the breathing cycle until the next inhalation period, thereby substantially reducing the average flow rate of breathing air and increasing the life of the battery and the filter by a corresponding amount.

Figure 2:
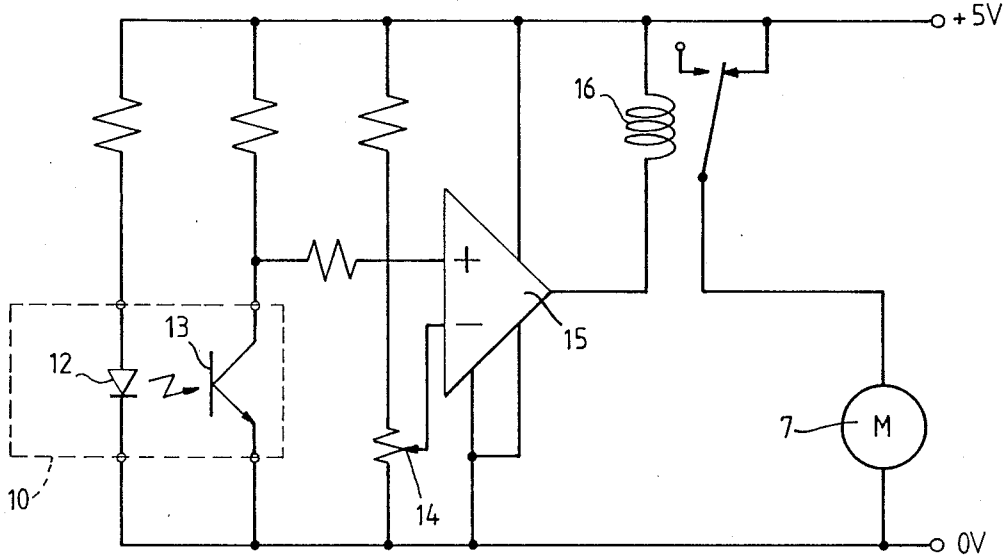
FIG. 2 is a diagrammatic representation of an electrical circuit for use in the embodiment of the invention illustrated in FIG. 1.

In FIG. 2 there is shown the electrical circuit incorporated in the positive pressure filter respirator of FIG. 1. The solid state infra-red proximity detector 10 comprises the diode 12 and the infra-red responsive transistor 13, the voltage across the transistor 13 increasing as the infra-red radiation received by the transistor 13 increases in consequence of the approach of the diaphragm 9 to the transistor 13.

A proportion of the voltage developed across the transistor 13 is selected by the adjuster 14 and compared with a standard voltage by a voltage comparator 15. The proportion of the voltage across the transistor 13 which is selected is advantageously chosen such that the voltage comparator 15 gives an output to energise the relay coil 16 and disable the fan motor 7 when the gas pressure within the orinasal mask 2 is positive due to exhalation, i.e. greater than the gas pressure in the space 20 within the outer mask 1.

The operation of the invention in the positive pressure filter respirator illustrated in FIG. 1 will now be described in relation to the circuit of FIG. 2.

When the wearer starts to inhale, the relative pressure drops, that is to say the gas pressure within the orinasal mask 2 falls below the gas pressure in the space 20 outside the orinasal mask 2 but within the outer mask 1. This drop in relative pressure causes the fan 6 to be immediately switched on, thereby sucking an excess of air into the space 20 within the outer mask 1. The gas pressure in the space 20 is thus increased relative to the gas pressure in the orinasal mask 2 with the result that the inhale valve 8 opens allowing clean filtered air to enter the orinasal mask 2 and the respiratory passages of the wearer.

When the wearer exhales, the gas pressure within the orinasal mask 2 rises relative to the gas pressure in space 20 and the inhale valve 8 closes. This increase in the relative gas pressure is detected as a result of movement of the diaphragm 9 towards the infra-red proximity detector 10 with the result that the fan 6 is switched off, thereby allowing the positive pressure in the space 20 relative to the pressure of the ambient atmosphere to vent to atmosphere through the filter 5. Also the excess pressure within the orinasal mask 2 causes the exhale valve (not shown) to open and allow the exhaled gases to be vented from the orinasal mask 2 direct to atmosphere.

Apart from a momentary pressure at the commencement of inhalation, there will always be a positive pressure within the inner orinasal mask 2 in positive pressure breathing apparatus according to the present invention. The pressure in the space 20 within the outer mask 1 but outside the orinasal mask 2 will be positive during inhalation, but will fall to ambient pressure during the exhalation period and the rest period of the breathing cycle.

In breathing apparatus which includes both inner and outer masks, the positive pressure breathing apparatus of the present invention is unique in providing for increase in the life of the filter by disabling the air mover in response to detection of an increase in the difference between the pressures in the inner and outer masks as a result of exhalation. It is the increased pressure of gas provided within the confined space of the inner mask as the wearer commences to exhale which causes the air mover to be switched off, giving a swift response and substantial increases in both filter life and battery life.

The positive pressure breathing apparatus according to the present invention has the further advantage over positive pressure breathing apparatus in which the air mover is controlled as a result of sensing a change in the pressure present in the space between the air mover and the filter that the effort required to cause the fan to switch on when inhalation commences is substantially less and there is therefore a much smaller physiological burden placed on the wearer by the apparatus of the present invention. This is in addition to the faster response to the commencement of the inhale part of the breathing cycle.

I claim:

1. Breathing apparatus for excluding noxious atmospheric gases from the respiratory passages of a wearer, the breathing apparatus comprising:

(a) an outer member, (b) an orinasal mask located within the outer member, (c) an inhale valve mounted in the orinasal mask and operable to connect the interior of the orinasal mask with the space within the outer member and outside the orinasal mask, (d) an exhale valve mounted in the orinasal mask and operable to connect the interior of the orinasal mask direct to the ambient atmosphere, (e) an air inlet to the outer member, (f) a filter mounted in the air inlet, (g) air moving means for moving air through the filter into the outer member to establish a pressure above ambient pressure within the outer member and outside the orinasal mask, (h) a power source for driving the air moving means, and (i) pressure responsive means responsive to the pressure difference between the pressure in the interior of the orinasal mask and the pressure in the space within the outer member and outside the orinasal mask for causing the power source to disable the air moving means at the commencement of an exhale period in a breathing cycle and to accelerate the air moving means at the commencement of an inhale period in the breathing cycle.

2. Breathing apparatus according to claim 1 wherein the outer member is a flexible hood.

3. Breathing apparatus according to claim 1 wherein the outer member is a full face mask.

4. Breathing apparatus according to claim 1 wherein the pressure responsive means comprises:

(a) a diaphragm mounted within the orinasal mask, (b) an infra-red detector mounted to the orinasal mask in the proximity of the diaphragm, the infra-red detector giving an output dependent on the position adopted by the diaphragm under the said pressure difference, and (c) control means responsive to the output of the infra-red detector for disconnecting the power source from the air moving means upon an increase in the said pressure difference on the commencement of exhalation.

5. Breathing apparatus according to claim 4 wherein the control means includes a relay operable when the said pressure difference increases above a predetermined level to disconnect the power source driving the air moving means.

6. Breathing apparatus according to claim 1 wherein the air moving means is a fan.

7. Breathing apparatus according to claim 6 wherein the fan is a centrifugal fan.

8. A positive pressure filter respirator comprising a full face mask including:

(a) an outer mask for engaging the head of a wearer to exclude noxious atmospheric gases from a region within the outer mask, (b) an orinasal mask within the outer mask and engaging the face of the wearer to surround his respiratory passages, (c) an inhale valve mounted in the orinasal mask and operable to connect the interior of the orinasal mask with the space within the outer mask and outside the orinasal mask, (d) an exhale valve mounted in the orinasal mask and operable to connect the interior of the orinasal mask direct to the ambient atmosphere, (e) an air inlet to the outer mask, (f) a filter mounted to the outer mask to filter air passing through the air inlet, (g) a fan located in the space within the outer mask and outside the orinasal mask for moving air through the filter into the outer mask to establish a pressure above ambient pressure within the outer mask and outside the orinasal mask, (h) a fan motor for driving the fan to move air through the filter, (i) detector means located within the orinasal mask for detecting an increase in gas pressure within the orinasal mask relative to the gas pressure in the outer mask consequent upon exhalation by the wearer, and (j) control means responsive to detection of the said increase in gas pressure within the orinasal mask by the detector means for disabling the fan motor.

9. A positive pressure filter respirator according to claim 8 wherein the detector means comprises a diaphragm and an infra-red proximity detector mounted near one another within the orinasal mask, the infra-red proximity detector giving an output dependent on the position adopted by the diaphragm in response to the difference in pressure between the gas pressure within the orinasal mask and the gas pressure within the outer mask.

10. A positive pressure filter respirator according to claim 8, wherein the detector means gives a signal upon detection of a predetermined increase in the gas pressure within the orinasal mask relative to the gas pressure in the outer member, and the control means is responsive to the said signal to disable the fan motor.

* * * * *